United States Patent [19]

Stahnke

[11] Patent Number: 5,022,301

[45] Date of Patent: Jun. 11, 1991

[54] MULTIPLEXED MULTIPLE INTENSITY REPRODUCING PIANO

[76] Inventor: Wayne L. Stahnke, 11434 McCune Ave., Los Angeles, Calif. 90066

[21] Appl. No.: 404,739

[22] Filed: Sep. 8, 1989

[51] Int. Cl.[5] ..... G10H 1/46; G10H 7/00

[52] U.S. Cl. ..... 84/21; 84/626; 84/633; 84/462

[58] Field of Search ..... 84/DIG. 3, 21, 462, 84/463, DIG. 29, 20, 22, 115, 462, 463, 617, 626, 633, 649, 658, 662, 665, 687–690, 711

[56] References Cited

U.S. PATENT DOCUMENTS 4,132,141 1/1979 Campbell et al. ..... 84/115
4,135,428 1/1979 Campbell .
4,307,648 12/1981 Stahnke .
4,593,592 6/1986 Stahnke .
4,913,026 4/1990 Kaneko et al. ..... 84/21

*Primary Examiner*—A. D. Pellinen
*Assistant Examiner*—Jeffrey W. Donels
*Attorney, Agent, or Firm*—Kelly Bauerfeld & Lowry

[57] ABSTRACT

A reproducing piano is provided which is capable of reproducing the notes of a chord or a sequence of multiple intensity notes within several groups of common intensity. This is accomplished by sorting the notes into a plurality of groups and then assigning intensity levels to the various groups so that notes within a group will be played at the same intensity. A limited number of solenoid driver circuits are multiplexed among the solenoids according to the grouping of notes, thereby providing faithful reproduction of the music, but at a lower cost than by individual control of each key.

15 Claims, 6 Drawing Sheets

MULTIPLEXED MULTIPLE INTENSITY REPRODUCING PIANO

BACKGROUND OF THE INVENTION

The present invention relates to a reproducing piano and more particularly to a reproducing piano that sorts the notes to be reproduced according to intensity and subsequently reproduces the notes at or near the original recorded intensity.

It is known to record performances of a piano on magnetic tape, for example, and reproduce the performance by playing the tape and causing the keys to be actuated mechanically. During the record mode, the piano is played by a musician, and sensors detect the timing and velocity with which the keys are depressed or the hammers are moved, and this information is stored digitally in a permanent memory, such as a magnetic tape. During playback, the digital information is retrieved from the tape and converted to control signals that energize actuators to play the keys in the same pattern and with the same dynamics as during the original performance.

In U.S. Pat. No. 4,307,648, which patent is incorporated herein by reference, there is disclosed a method and apparatus for measuring the dynamics of a piano performance wherein a shutter is provided for each hammer shank of the piano, as well as a separate optical switch assembly and counter that is responsive to the trigger signals produced as the shutter eclipses the light beam, the counter is responsive to an initiating signal from the optical switch assembly to start the counter and to an end of count signal from the optical switch to terminate the count, the total count defining the count increment. The total count registered comprises a digital signal constituting an inverse function of the near terminal hammer velocity, that is, the velocity of the hammer just before it strikes the string. Digital information corresponding to the count is stored on magnetic tape for recall during playback and reproduction of the original performance.

A microprocessor retrieves the data from the magnetic tape and produces a digital drive value corresponding to the particular key velocity required. A digital-to-analog converter converts the digital drive value to an analog voltage, and a feedback servomechanism comprising a plurality of operational amplifiers and a sense coil is connected to a solenoid and energizes the solenoid with a current that produces a constant velocity. The velocity is maintained constant by means of the auxiliary sense coil within which a permanent magnet connected to the solenoid plunger moves; the coil is connected to the input of the first operational amplifier. This circuit arrangement causes the solenoid to operate as a linear motor with constant velocity, thereby ensuring that transit times and key velocity can be maintained within very close tolerances so that the playback performance is an accurate reproduction of the original performance.

This linear key velocity technique and system for playback of musical performances yields an extremely accurate reproduction; however, at a considerable expense. Each of the 88 keys has its own operational amplifier servomechanism comprising: a digital-to-analog converter, three operational amplifiers and an input from a triangular wave generator as shown in FIG. 2 of U.S. Pat. No. 4,593,592, which is hereby incorporated by reference. For all the keys on a piano, then, this extremely accurate reproduction system requires a total of 264 operational amplifiers and 88 digital-to-analog converters in order to drive the 88 solenoid actuators for the 88 key analog to digital converters.

Considering that the maximum number of notes that can be played by a performer is twelve, most of the 88 individual circuits of the key velocity reproduction system are not being used at any one time.

Accordingly, it is desirable to provide a reproducing piano which multiplexes a number of digital-to-analog converters and a number of driving circuits in order to reduce the expense and the complexity of 88 individual circuits.

A type of multiplexing reproducing piano is known from U.S. Pat. No. 4,135,428. This known reproducing piano has two multiplexed pulse-width modulators for driving all of the solenoid actuators, one of which is assigned to the bass half of the keyboard and the other of which is assigned to the treble half of the keyboard. With this arrangement, notes that are played on the same half of the keyboard and substantially concurrently, such as the notes of a chord, are all reproduced at the same intensity, because all the treble solenoid actuators are driven from one pulse-width modulator drive signal output and all the bass solenoid actuators are driven from the other pulse-width-modulator drive signal output. This system then reproduces two concurrently struck notes on the same half of the keyboard with equal intensity, and similarly it reproduces all of the notes in most chords with equal intensity. When all of the notes are played with equal intensity, the reproduction has a certain "mechanical" quality to it, which is both noticeable and objectionable. Some of this "mechanical" quality may be overcome by time shifting the notes using known techniques, but this requires an extensive amount of processing of the recorded performance in order to produce a recording tape for playback.

Accordingly, it is desirable to provide a reproducing piano which has a number of possible solenoid actuator drive signals to which the keys may be multiplexed, thereby reproducing multiple sound intensities for notes which are struck substantially concurrently. Moreover, it is desirable to provide a "non-mechanical"-sounding reproducing piano which does not require extensive monetary investments in the editing and processing required between the recording stage and the reproduction stage of the musical performance.

SUMMARY OF THE INVENTION

The disadvantages of expense and complexity, on the one hand, and objectionable quality of the sound of the reproduction on the other hand are overcome by the present invention, in one form thereof, by providing a plurality of independent drive signals which can be varied digitally to provide three or more sound intensity levels at which any one note can be reproduced substantially concurrently with any other note. Each of the 88 keys has a solenoid actuator and a decoder which selects from the two or more independent solenoid drive signals the corresponding one to drive the solenoid actuator during the time segment reproduced.

Applicant's invention reproduces a piano performance more faithfully and with a more natural sound than the two drive signal system described above, by grouping the notes that are performed substantially concurrently within a specific time segment into a plurality of individual sound intensity groups. Thus, if the original performance had a prominent note played concurrently with other notes, the prominent note would be reproduced at one sound intensity and the remainder of the notes grouped into one or more sound intensities upon reproduction. The solenoid actuator of the prominent note will be decoded to the prominent sound intensity drive signal and the remainder of the notes will be averaged within their groups and each group will have the solenoid actuators for its keys decoded to a corresponding sound intensity drive signal. In this manner, only a small number of operational amplifiers and digital-to-analog converters are required to reproduce a piano performance, with a natural sound and negligible pre-reproduction processing.

In a system constructed in accordance with this invention which employs three drive signals for actuating the keys and causing the hammers to strike the piano strings, one of the three drive signals would provide a "loud" group sound intensity and a second drive signal would provide a "soft" group sound intensity. The third drive signal would be typically reserved for the "hold" intensity, which is a level that energizes the solenoid actuator just enough to hold the key depressed, thereby reproducing the effect of the performer holding down the keys during the performance. In unusual cases, when many notes are played or the hold intensity is not required, the third drive signal may be used to provide a third sound intensity, in which case the notes are sorted into three groups, providing an even more faithful reproduction. Conceptionally, the three drive signal system has a fourth sound intensity drive signal, the null intensity, which is always zero. An open circuit connection input to each solenoid actuator decoder provides the null intensity function. All notes which are not played or are "released" after being played with a "loud", "soft", or "hold" drive signal, are assigned to the null sound intensity.

The digital data concerning the notes to be reproduced, and the sound intensity of each of the notes may be recorded on a permanent medium using, for example, a method and apparatus as described in U.S. Pat. No. 4,593,592. This data is subsequently supplied to a programmable microprocessor. The program of this computer divides the continuous digital data stream into various time segments, which are not necessarily equal, and then sorts the notes which are to be reproduced within each time segment. As mentioned above, the notes typically are sorted into a "loud" group, a "soft" group, a "hold" group and a "null" group. The notes in the "loud" group are assigned the sound intensity level of the loudest note within the loud group. The sound intensity of the "soft" group is determined by a statistical average of the sound intensities of every "soft" note reproduced within the time segment. The "loud" sound intensity level and the "soft" sound intensity level are converted to digital numbers which control the drive signal duty cycle and thereby control the strength with which the solenoid actuator strikes the key. The digital information for the hold group and the null group are predetermined and are simply assigned as required. Once assigned, the sound intensity drive signals usually remain constant within a time segment, and transitions from "loud" to "hold", "soft" to "hold", "loud" to "release", "soft" to "release", or "hold" to "release" are accomplished by having the decoder select the next required drive signal for the note.

The programmable microprocessor operates so rapidly relative to the playing of the keys that it is possible for the sorting and the sound intensity assigning to be done in real time as the digital tape of a previously recorded performance is supplied at the input to the microprocessor. Alternatively, the sorting and sound intensity assignments can be accomplished as an intermediate step in which case an output tape can be produced which then does nothing but set the sound intensities to be produced in each time segment and instruct the decoder of each key as to which sound intensity drive signal to select in each time segment in a real-time reproduction.

Briefly stated, the invention, in one aspect thereof, provides a reproducing piano for reproducing a sequence of notes from data representing a musical performance. This data, for example, may be recorded on a recording medium such as a disk or magnetic tape or it may be in the form of a data stream from a source such as a Midi synthesizer. The reproducing piano includes a plurality of keys, each corresponding to a respective note of the sequence of notes, and a plurality of solenoid actuators, each connected to a respective key of said plurality of keys. The entire sequence of notes is divided into segments which are sequentially reproduced, it is determined which notes are to be reproduced within each of the segments, and notes are sorted, within each segment according to their sound intensity in the performance, into a plurality of groups. The system assigns a representative sound intensity level to each of the groups of sorted notes, and each solenoid actuator reproduces each note at its respective representative sound intensity within its respective time segment. For purposes of this application, the term "key" refers to the mechanical key-action assembly that causes a hammer to strike a string when the key-action assembly is actuated by a performer. It is not limited to the actual playing key itself and may comprise other portions of the action.

The invention, in another aspect thereof, also provides a method of reproducing a sequence of notes on a reproducing piano from a stream of data representing a musical performance. The method includes the the steps of: playing back the sequence of notes from the recorded performance, dividing said sequence of notes into a plurality of consecutive segments, determining which notes are to be reproduced in each of the consecutive segments, sorting the notes to be reproduced in each of the consecutive segments according to sound intensity into a number of groups, assigning a representative sound intensity to each of the groups, and driving each key corresponding to each of the notes to be reproduced to produce the representative sound intensity of each respective group at the respective position within the segment.

It is an object of this invention to provide a method and an apparatus for reproducing a sequence of notes with a natural sound which is less expensive than presently available.

It is a further object of this invention to provide a method and apparatus for reproducing a sequence of notes which can reproduce a performance with a natural sound that does not require intermediate processing and editing.

These and other objects and features of the present invention will become apparent from the detailed description, taken together with the accompanying drawings.

DETAILED DESCRIPTION OF THE INVENTION

The invention will be described in connection with musical data in a time division multiplexed format and in connection with expression achieved by modulation of the width of the pulses applied to drive the solenoids. The invention, however, is not restricted to use with such data format or such means for achieving expression.

Figure 1:
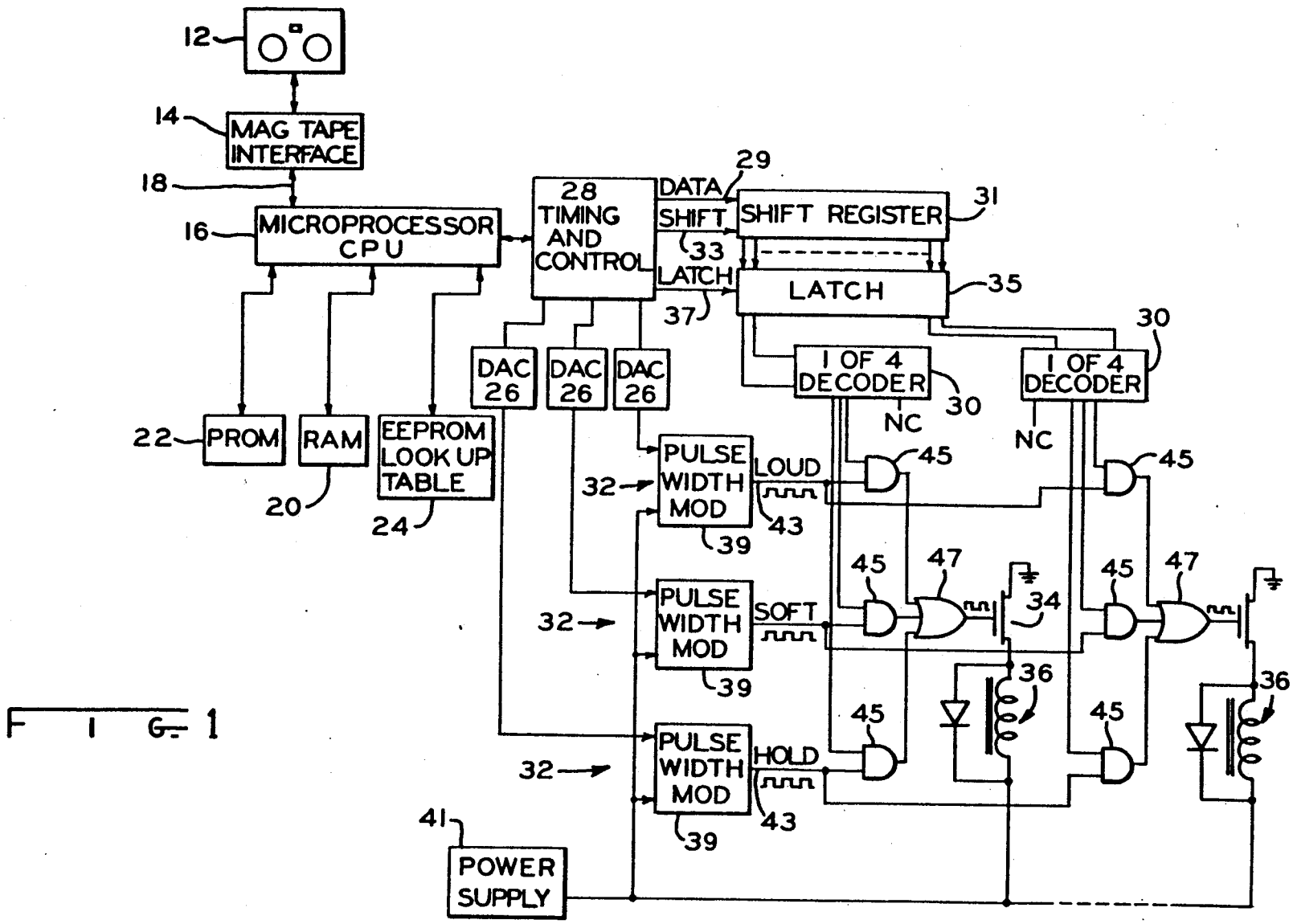
FIG. 1 is a functional block diagram of the reproducing piano system from the recorded performance input to the solenoid actuators which play the keys.

Referring now to FIG. 1, one embodiment of the invention comprises a digital playback unit 12 which has stored digitally, in a reproduceable medium such as magnetic tape, the inverse hammer velocities for a sequence of notes on a piano especially equipped for such purposes such as the one discussed in U.S. Pat. No. 4,593,592, in which a digital time record of every note that is played and the intensity of every note played is produced. A magnetic tape interface 14 receives the data from the digital playback unit 12 and converts the signals into a form which can be read into the microprocessor 16 without changing its information content. The digital information is read in through input port 18, thereby supplying to the microprocessor the time relationship of the notes to be reproduced, the notes to be played, and the intensity in the form of inverse hammer velocity that the note had during the original performance. The microprocessor 16 divides the continuous record of notes played and sound intensities into individual time segments. This information is then stored in random access memory 20 and further processed by the programs stored in the programmable read only memory 22. The sorting and reproduction programs delay the start of the reproduction slightly and then the playback of the notes of each segment is kept in the proper sequence with respect to the notes of the other time segments.

Figure 8:
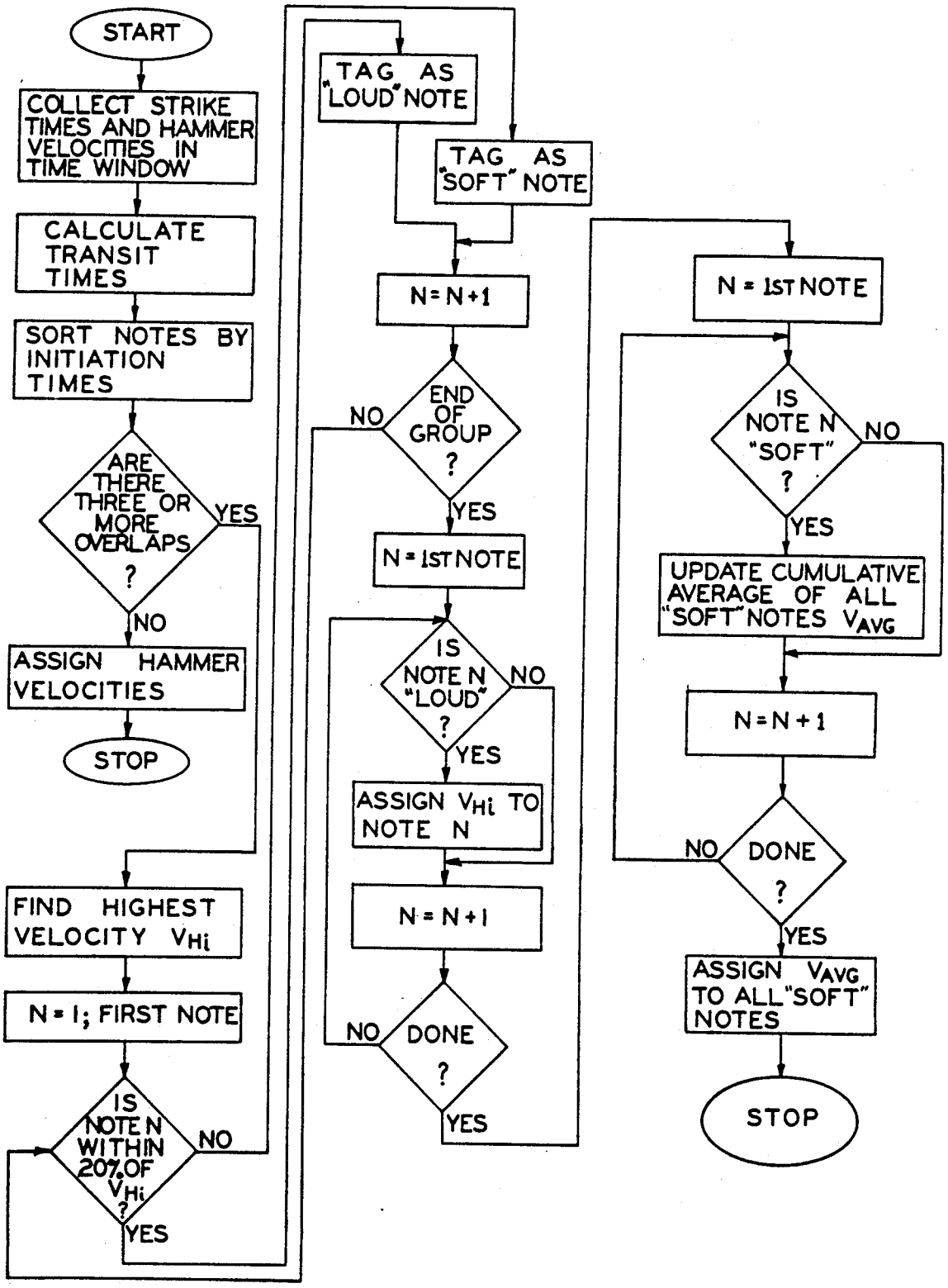
FIG. 8 is a flow chart detailing the sorting program used by the microprocessor to sort notes.

In a preferred embodiment of the invention, the microprocessor 16 performs the note sorting and sequencing according to the program shown in FIG. 8. The first portion of the program collects, calculates and stores in RAM 20 the time information for each note in the time segment, also known as the time window. Once the initiation times and the duration times of all the notes are established, the program examines these times to see if more than three notes ever overlap within the time segment. If three or fewer notes overlap in the time segment, then the system has sufficient circuitry to reproduce these notes without further processing. Therefore, the hammer velocities that determine the sound intensity of the notes are assigned directly and the sorting and sequencing program is completed for this segment. If there are more than three notes being played at any one time, then some approximations must be made because the simplified circuitry cannot necessarily reproduce every note in the time segment with a one-to-one correspondence to the level. In such a case, the data stored in RAM 20 is examined to find the note with the highest hammer velocity and this note is labeled as "loud". The remainder of the notes in the segment are examined to see if they are within a small percentage, such as 20%, of the loudest note and if so, these notes are also labeled "loud". At the end of this examination, the "loud" group of notes is collected in RAM 20. All of these notes will be reproduced at the same sound intensity as that produced by the hammer velocity of the loudest note of the group. After the "loud" group has been processed, the remaining notes are gathered into a "soft" group and an average sound intensity level of the notes in the soft group is calculated. A hammer velocity corresponding to this average sound intensity is then assigned to each of the notes of the "soft" group. This completes the note sequencing and sorting program for this time segment and the results are stored in RAM 20.

Figure 9:
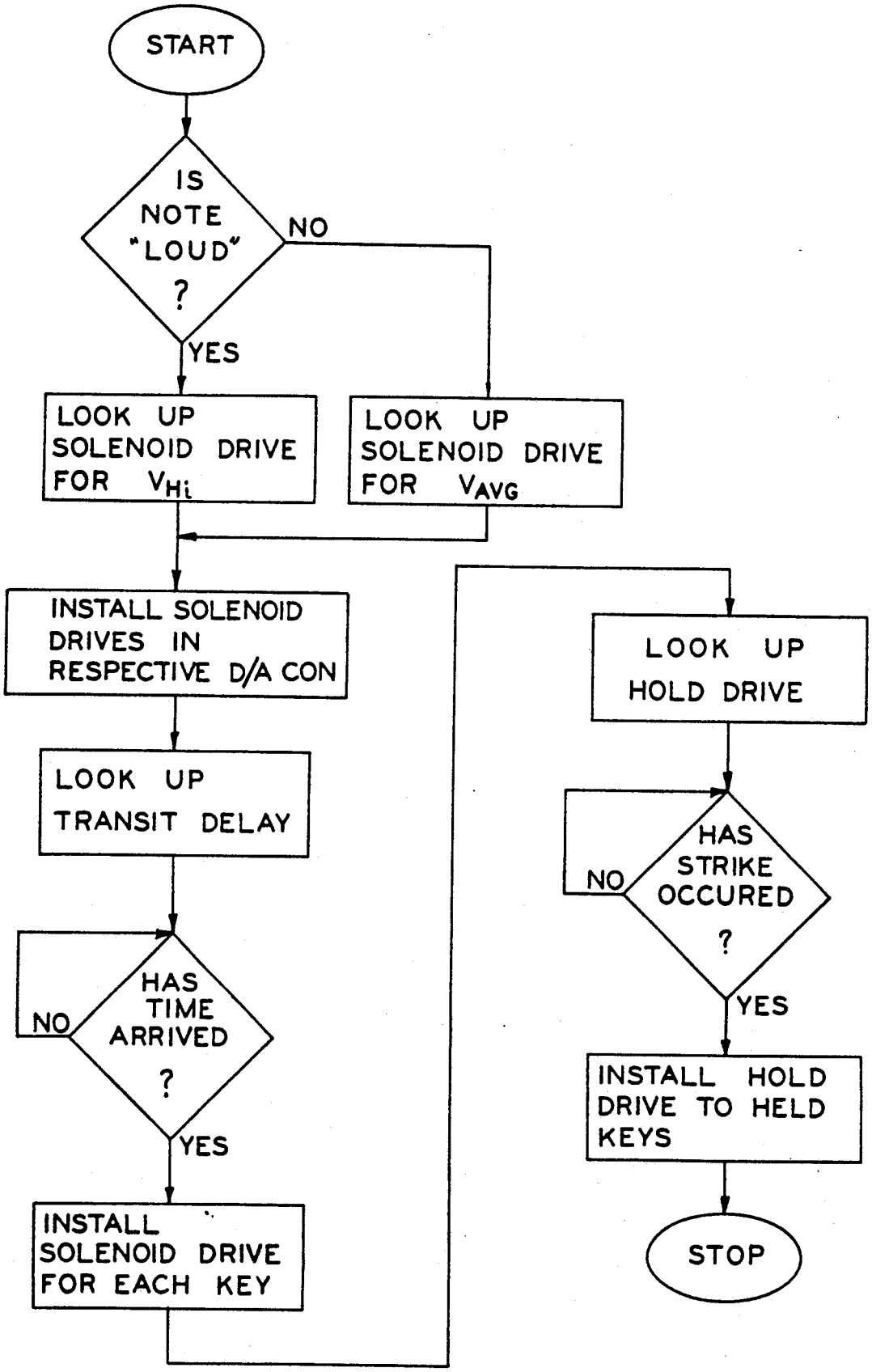
FIG. 9 is a flow chart detailing the program for reproducing each note after it has been sorted into groups for reproduction.

Next, the microprocessor 16 executes one of the two note reproducing programs shown in FIGS. 8 and 9. The program shown in FIG. 9 is executed when there are very few notes played at the same time and each of the notes can be reproduced at its original sound intensity. The microprocessor 16 in such a case looks up each corresponding solenoid drive from the EEPROM 24 and installs each digital solenoid drive level in a respective digital-to-analog converter 26. Data from timing and control circuit 28 is connected by bus 29 to shift register 31 and the shift command is connected thereto over line 33. The time division multiplexed data is shifted through shift register 31 and then latched into a plurality of one-of-four decoders 30 by latch 35, the latter being connected to timing and control circuit 28 over latch line 37. Shift register 31 has 88 stages corresponding to the 88 keys of the piano and there are 88 one-of-four decoders 30, also assigned respectively to the various keys. Key actuation data will be shifted into stages of shift register 31 corresponding to keys to be depressed within a given time window, such as the window shown in FIG. 5 for the A#, G and D# keys. A two-place binary number within each of the shift register stages controls one-of-four decoder 30 to activate one of its four outputs corresponding to a "loud" intensity, a "soft" intensity, a "hold" intensity or a null condition, in which case the unconnected "NC" output line would be activated.

After the solenoid drive level has been set, the microprocessor 16 and the timing and control circuit 28 determine the time for each solenoid to be energized, at which time the decoder 30 selects the desired solenoid drive circuit to drive each solenoid. Each of the solenoid drive circuits 32 comprises a pulse-width modulator 39 having one input connected to a corresponding digital-to-analog converter 26 and a further input connected to power supply 41. Pulse-width modulators 39 produce on their outputs 43 pulse streams wherein the widths of the individual pulses vary depending on the analog value from digital to analog converter 26, which corresponds to the intensity of the note to be played. AND gates 45 have one of their inputs connected to respective outputs of decoder 30 and the other inputs are connected to the outputs of pulse-width modulators 39 of the loud, soft and hold values. The outputs of AND gates 45 are combined by OR gate 47 and control transistor 34 to drive solenoid 36. There are 88 such solenoids 36 connected to the respective keys as illustrated in FIG. 2.

If, in the original performance, after the striking of either a "loud" note or a "soft" note, one or more of the notes were held by holding the key depressed after striking the note, then the microprocessor 16 and the timing and control circuits 28 will reassign that key to the "hold" level solenoid drive circuit 32 for as long as the key was held in the original performance.

Figures 2, 5:
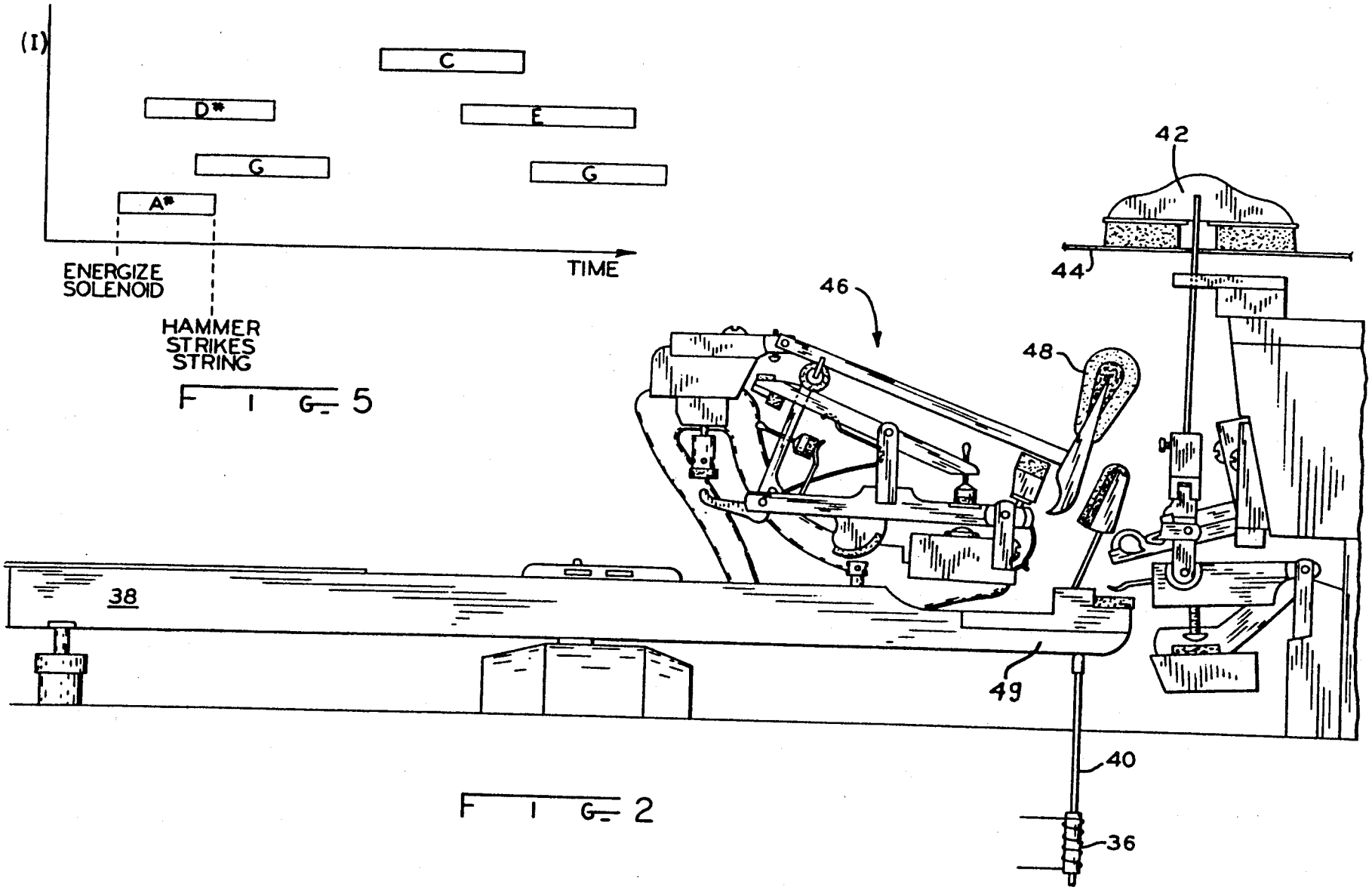
FIG. 2 is a partial elevation view of a representative piano key including the hammer mechanism, the damper mechanism and the solenoid actuator.
FIG. 5 is a diagrammatic representation of key activation versus time for two successive segments.

FIG. 2 shows a representative key 38 and conventional action 46 of the reproducing piano which can either be played in the normal manner by depressing key 38 or be operated as a reproducing piano. When operated as a reproducing piano, solenoid 36 drives pushrod 40 which then drives the end 49 of key 38 upwardly. If the solenoid 36 is driven with a sufficiently large current, the pushrod 40 drives the key 38 with sufficient velocity to cause hammer mechanism 46 to throw hammer 48 against piano string 44 thereby sounding the note of the string 44. If after the hammer 48 strikes the string 44, driving the solenoid 36 at the "hold" level will cause the pushrod 40 to hold the key 38 depressed and the damper mechanism 42 elevated from the piano string 44, allowing the string 44 to vibrate freely. The velocity with which hammer 48 strikes string 44 is determined by the effective value of the pulse-width modulated drive current in solenoid 36 for driving actuator 40.

Figure 4:
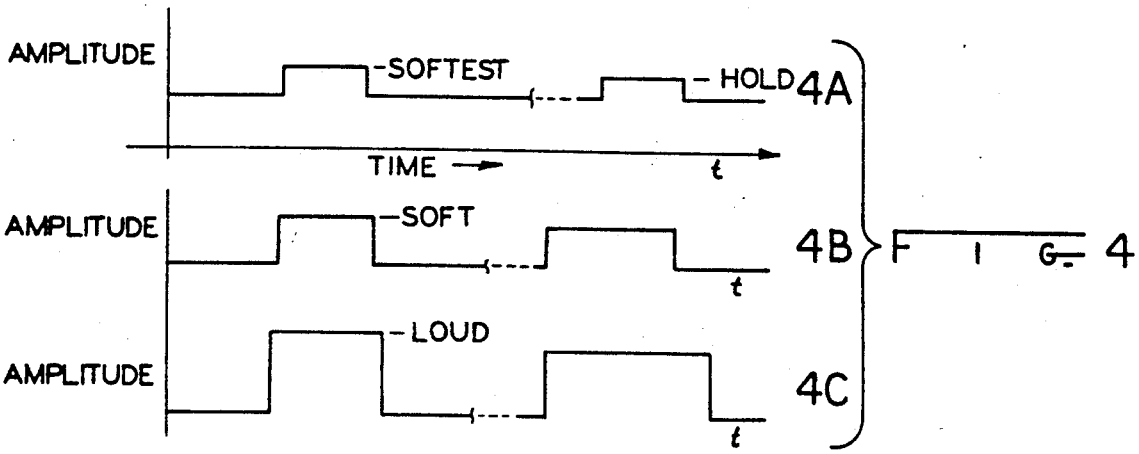
FIG. 4 is a graph showing the value of the current amplitude of the drive signals for two different time segments.
Figure 7:
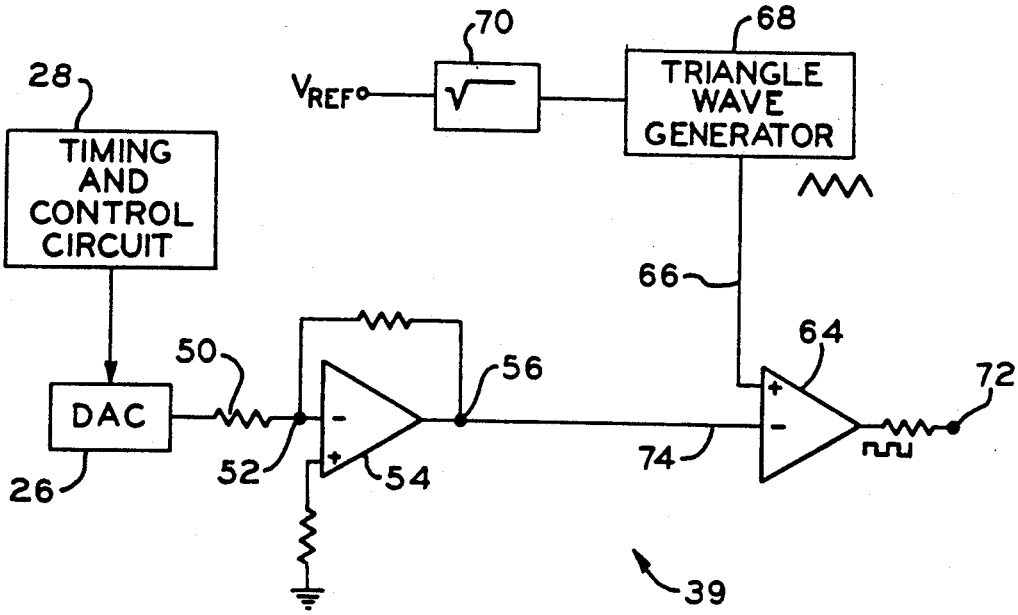
FIG. 7 is a schematic diagram of one of the pulse-width modulator circuits.

The output of digital-to-analog converters 26, as shown in FIG. 4, controls the duty cycle of the rectangular pulse output of solenoid drive circuits 32 by pulse-width modulation. It is well known that increasing the duty cycle of a rectangular wave signal increases the effective current of that signal. A known pulse-width modulator circuit 39 which can be used for solenoid drive circuit 32 is shown in FIG. 7. The output of digital-to-analog converter 26 is essentially a DC voltage which changes the switching point of the final operational amplifier shown in FIG. 7 from a symmetrical position with regard to the triangular wave input to the non-symmetrical switching position and will thereby have a rectangular output signal of greater than 50% duty cycle.

The output of DAC 26 is connected through input resistor 50 to a summing node 52 connected to the inverting input of operational amplifier 54. The output 56 of operational amplifier 54 is connected to one input of comparator 64. The other input 66 to comparator 64 is connected to triangle wave generator 68, which is fed by a reference voltage through square-root circuit 70. Comparator 64 produces on output 72 a pulse-width modulated signal wherein the average voltage is proportional to the input on line 74. This technique of providing a pulse-width modulated signal to drive a solenoid is well known in the field of servo circuit design. As the pulse width increases, the solenoid is driven with higher average current, thereby increasing the force and velocity with which key 38 is driven and increasing the intensity with which hammer 48 strikes string 44 (FIG. 2).

Figure 3:
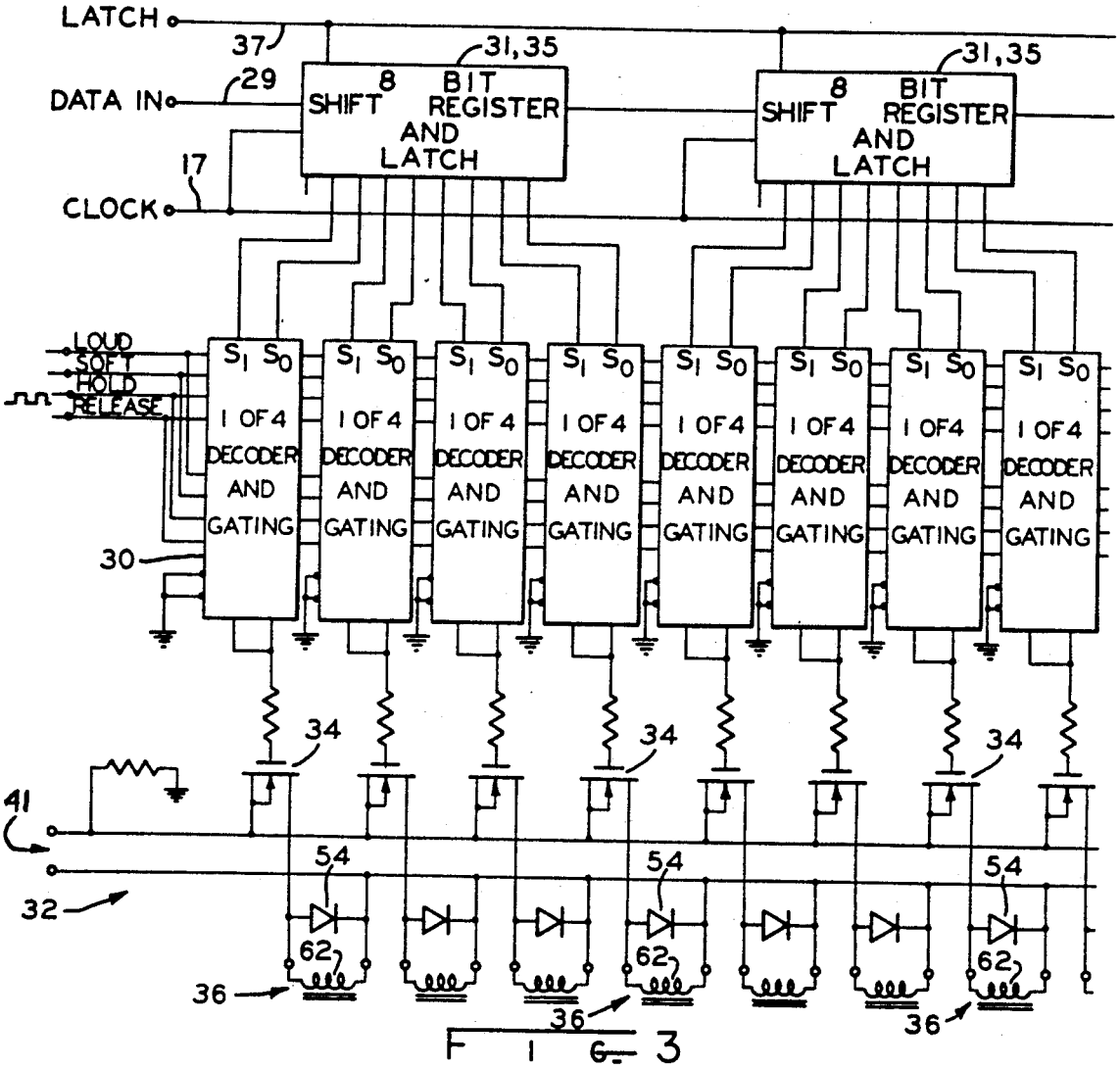
FIG. 3 is a detailed block diagram showing the solenoids and their respective drivers and decoders.

FIG. 3 illustrates the solenoid decoding and driving circuitry of FIG. 1 in somewhat greater detail.

Figure 6:
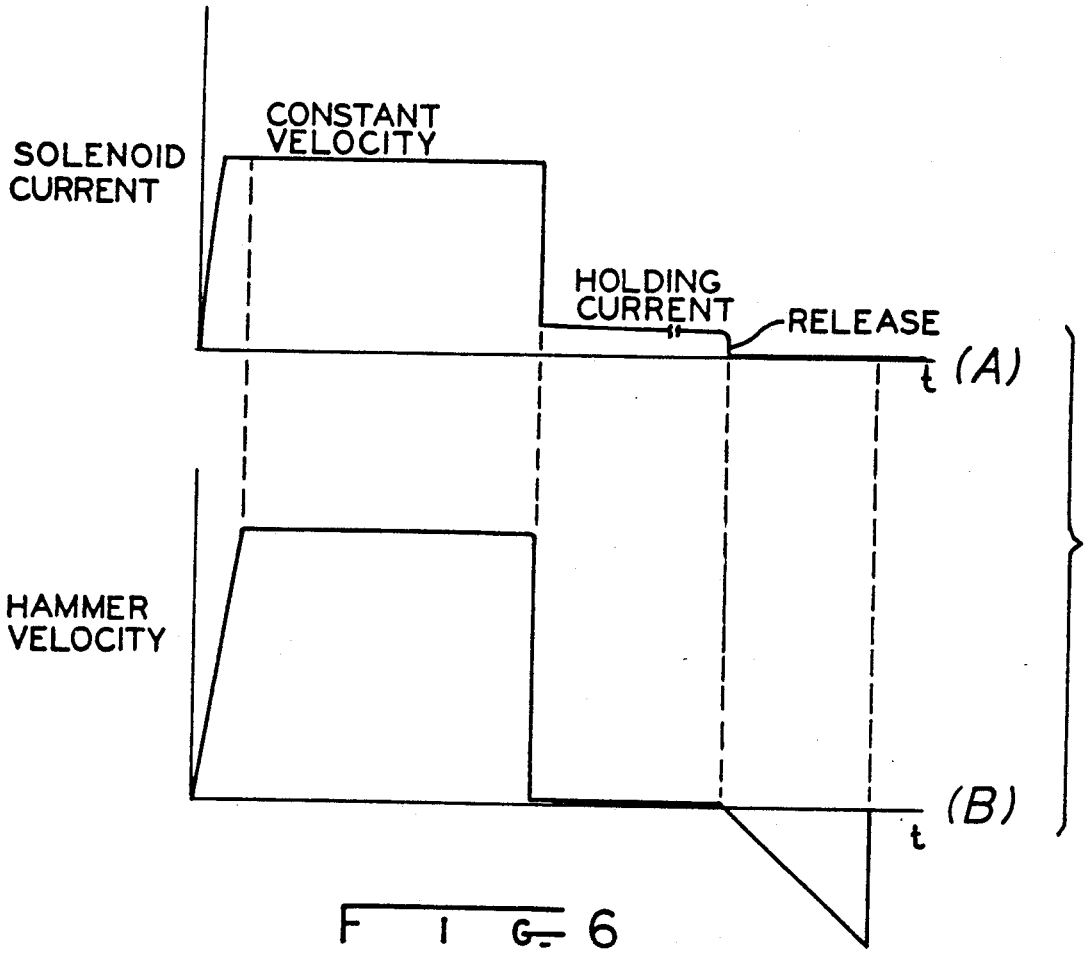
FIG. 6 is two corresponding graphs 6*a* and 6*b* respectively showing the relationship between solenoid current and the velocity of the key which the solenoid plays.

Four solenoid drive signals, three from solenoid drive circuits 32 and a fourth which is a null circuit or an open circuit are connected to 88 one-of-four decoders 30. Of the four signals connected to the decoder, only one will be selected to drive solenoid drive transistor 34. The selection is made by digital logic acting upon the two inputs $S_0$ and $S_1$ of each decoder. Each selector input has two possible binary states, either logic 1 or logic 0, and together $S_0$ and $S_1$ can select among the four different inputs. The selector inputs are provided by the microprocessor 16 and the timing control circuit 28. Together they constantly update the data in 22 eight-bit latching shift registers 31, 35. In the preferred embodiment, each of the 88 decoders must select one of the four solenoid drive signals including the null signal. If a note is to be reproduced within a time segment, at the note initiation time which is stored in RAM 20, the respective shift and latch register 31, 35 will select one of the outputs of one of the three solenoid drive circuits 32 for the length of time corresponding to the determined hammer velocity and transit time set forth in the EEPROM lookup table 24, and after that time either the "hold" or the "release" solenoid drive signals are selected according to the note information stored in RAM 20. The output of each decoder drives its respective solenoid drive transistor 34, which is connected in series with solenoid 36 across the power supply 41. As shown in FIG. 6, as the solenoid drive transistor 34 is driven by the pulse-width modulated signal, the effective solenoid current switched by the transistor 34 from the power supply 41 into the coil 62 of solenoid 36 will determine with what force actuator 40 will drive the key 38 and the ultimate velocity with which hammer 48 will strike the string 44. Diode 54 allows the flux in the solenoid to die out rapidly by short circuiting the solenoid when the solenoid is no longer driven by transistor 34.

After all the notes of the segment have been reproduced by means of the mircoprocessor programs and the circuitry described above, each subsequent segment is reproduced using the same microprocessor programs and the circuitry until all segments, and of course the entire sequence of notes, have been reproduced.

Although the invention has been described as having a preferred design of four solenoid drive signals including the null signal, it will be appreciated by those skilled in the art that by using other, larger decoders and by changing the microprocessor program the notes can be sorted into a larger number of groups. For example, the notes could be grouped into eight different intensities, including a "hold" condition and a "release" condition. In this case, one-of-eight decoders would be utilized and the pulse-width modulation circuitry would be replicated seven times.

In the illustrated embodiment, the data representing the musical performance is recorded on a reproduceable medium such as a magnetic tape. It will be understood, however, that this data may be in the form of a data stream from, for example, a Midi synthesizer.

While this invention has been described as having a preferred design, it will be understood it is capable of further modification. This application is, therefore, intended to cover any variations, uses or adaptations of the invention following the general principles thereof and including such departures from the present disclosure as come within known or customary practice in the art to which the invention pertains and fall within the limits of the appended claims.

What is claimed is:

1. A reproducing piano for playing a plurality of notes in a musical sequence from data representing a musical performance, comprising:

a plurality of key means each corresponding to a respective note, a plurality of actuator means, each associated with a respective note and connected to a respective said key means for actuating the key means to produce a respective note, means for reading note identity and note intensity for the note from the data and for sorting the notes of said sequence of notes into a plurality of groups according to intensity, each of said groups having the possibility of containing a plurality of notes, means for assigning a representative intensity to each of said groups, means for assigning each actuator means to the group containing its associated note, and means for driving each said actuator means with a drive signal corresponding to the intensity of its assigned group to sound the respective note, wherein all actuator means assigned to a given group are driven with a substantially equal drive signal.

2. The reproducing piano of claim 1 wherein the data representing a musical performance is recorded on a recording medium and said means for reading note identity and note intensity reads such data from the recording medium.

3. The reproducing piano of claim 1 wherein there are fewer said groups than playing keys of the piano.

4. The reproducing piano of claim 1 wherein said means for sorting sorts the notes into groups fewer in number than the number of notes in said sequence.

5. The reproducing piano of claim 1 wherein one of said groups corresponds to a holding intensity whereby notes that had previously been played are held.

6. The reproducing piano of claim 1 wherein said actuator means comprises a solenoid, said solenoid including a drive coil connected to said driving means, there being a plurality of solenoids connected to a single driving means.

7. The reproducing piano of claim 1 wherein said key means comprises a playing key and an action, and each said actuator means is connected to the playing key of its respective key means.

8. The reproducing piano of claim 1 wherein said means for reading note identity and note intensity comprises a microprocessor having a memory in which are stored the note identities and note intensities, and said means for driving said actuator means comprises a shift register and decoder circuit means interposed between said microprocessor means and said actuator means and having a plurality of stages connected respectively to said actuator means.

9. A reproducing piano for playing a plurality of notes in a musical sequence from data representing a musical performance, the data being representative of note identity, note intensity, time of note actuation and a time of note release, said piano comprising:

a plurality of key means corresponding respectively to a plurality of notes playable by the piano, a plurality of actuator means, each associated with a respective note and connected to a respective said key means for actuating the key means to produce a respective note, means for reading note identity and note intensity for the note from the data and for sorting the notes of said sequence of notes into a plurality of groups according to intensity, each of said groups having the possibility of containing a plurality of notes, means for assigning a representative intensity to each of said groups, means for assigning each actuator means to the group containing its associated note, means for driving each said actuator means with a drive signal corresponding to the intensity of its assigned group to sound the respective note, wherein all actuator means assigned to a given group are driven with a substantially equal drive signal, said means for driving causing said actuator means to hold their respective given key means in an actuated state until the time of note release occurs.

10. The reproducing piano of claim 9 wherein the data representing a musical performance is recorded on a recording medium and said means for reading note identity and note intensity reads such data from the recording medium.

11. A method for playback on a reproducing piano a sequence of notes from a stream of data representing a musical performance, wherein said piano comprises a plurality of key means corresponding to respective notes, and the stream of data includes data representing the identity, intensity and sequence of notes from the musical performance, said method comprising the steps of:

reading data representing the sequence of notes from the stream of data;

dividing said sequence of notes into a plurality of consecutive segments;

sorting the notes to be reproduced in each segment into a plurality of groups according to intensity;

calculating a representative intensity for each of said groups; and driving each key means corresponding to the notes to be reproduced in the segment with a predetermined drive to reproduce each note at the representative intensity of the respective group.

12. A method according to claim 11 further comprising the steps of:

determining which notes are to be held subsequent to being played and how long each note is to be held; and driving each key corresponding to each note-to-be-held with a predetermined holding force for said length of time subsequent to the playing of the note.

13. The method of claim 11 wherein the step of calculating comprises computing the average intensity for a plurality of notes in a group, and assigning said average intensity as said representative intensity.

14. The method of claim 13 wherein the step of sorting comprises: sorting the notes into a loud group and a soft group, selecting a solenoid drive intensity for the loud note group, averaging the intensities for the soft note group and assigning the average intensity to the soft note group.

15. The method of claim 11 wherein the step of sorting comprises: sorting the notes into a loud group and a soft group, selecting a solenoid drive intensity for the loud note group, averaging the intensities for the soft note group and assigning the average intensity to the soft note group.

* * * * *